US006724917B1

(12) United States Patent
Ohashi et al.

(10) Patent No.: US 6,724,917 B1
(45) Date of Patent: Apr. 20, 2004

(54) CONTROL APPARATUS FOR VENTILATING A TUNNEL

(75) Inventors: Hiroyuki Ohashi, Tokyo (JP); Toshihiro Koyama, Saitama-ken (JP); Kazuchika Nagao, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 604 days.

(21) Appl. No.: 09/660,201

(22) Filed: Sep. 12, 2000

(30) Foreign Application Priority Data

Sep. 13, 1999 (JP) ..... 11-258887

(51) Int. Cl.[7] ..... G01C 3/00; E21F 1/00

(52) U.S. Cl. ..... 382/104; 454/166

(58) Field of Search ..... 382/104; 356/437, 356/438, 439; 348/82, 122, 148, 149; 454/166

(56) References Cited

U.S. PATENT DOCUMENTS 6,186,888 B1 * 2/2001 Ohashi ..... 454/167
6,389,164 B2 * 5/2002 Li et al. ..... 382/176

FOREIGN PATENT DOCUMENTS

JP 06-137099 * 5/1994 ..... E21F/1/00
JP 11-044200 * 2/1999 ..... E21F/1/00
JP 11-064221 * 5/1999 ..... G01N/21/59

OTHER PUBLICATIONS

Jacques, Some Experience with Ventilation Control Based on Traffic Data, published in "Tunnel Control & Communication", A. Vardy Edt., 2nd International Conference, Amsterdam, 1997, ppt. 235–257.*
"Tunnel Ventilation Control System", Toshiba Technical Journal, pp. 1–28, 1992.

* cited by examiner

*Primary Examiner*—Brian Werner
*Assistant Examiner*—Ryan J. Miller
(74) *Attorney, Agent, or Firm*—Oblon, Spivak, McClelland, Maier & Neustadt, P.C.

(57) ABSTRACT

A control apparatus for a ventilator that ventilates a tunnel in response to visibility of the inside of the tunnel, including at least one picture image input device configured to take a picture of the inside of the tunnel, a visibility index determination device configured to determine a visibility index value on the basis of a picture image data of the picture taken by the picture image input device in light of a table representing a relationship between the picture image data and the visibility index value, a feedback controller configured to calculate an operation command for operating the ventilator on the basis of a feedback control value calculated by comparing the visibility index value with a target value of the visibility index value.

8 Claims, 8 Drawing Sheets

CONTROL APPARATUS FOR VENTILATING A TUNNEL

CROSS REFERENCE TO RELATED APPLICATION

This application claims benefit of priority to Japanese Patent Application No. 11-258887 filed Sep. 13, 1999, the entire content of which is incorporated by reference herein.

BACKGROUND OF THE INVENTION

1. Field of the Invention

This invention relates to a control apparatus for ventilating a tunnel that operates ventilators in a tunnel so as to keep visibility for drivers within a satisfactory range. The visibility, for example, represents air pollution density in the tunnel.

2. Discription of the Background

Concerning a road tunnel for automobiles, it is essential to control air pollution density to be within a satisfactory range and to keep visibility for drivers well from the point of view of guaranteeing drivers' safety and comfortableness.

In general, a ventilator, that may include a blower, an exhauster, a jet fan, a dust chamber or the like, is set in a tunnel, and a control apparatus is provided for operating the ventilation system efficiently according to the air pollution density.

There are several kinds of control systems that operate the ventilator. FIG. 1 is one example of a conventional control system. FIG. 1(*a*) is a schematic view showing one example of the installation of ventilation equipment in a tunnel. FIG. 1(*b*) is a block diagram of a conventional control apparatus.

The ventilation equipment includes a TC(Traffic Counter) sensor 51 that measures speeds of automobiles traveling on a road and the number of automobiles, and distinguishes between small cars and large-sized cars, a VI(Visibility Index) sensor 52 that measures a VI value in the tunnel, a CO(Carbon monoxide) sensor 53 that measures carbon monoxide density in the tunnel, an AV(Wind velocity) sensor that measures a wind direction and a wind velocity in the tunnel, and a ventilator 55 having jet fans or the like. The VI value is an index that represents visibility in the tunnel. Where the VI value indicates 100%, the visibility is completely clear. Where the VI value indicates 0%, it means completely dark.

The control apparatus, as shown in FIG. 1(*b*), includes a traffic volume predictor 56 that predicts the volume of traffic in the tunnel in a fixed cycle on the basis of an output of measured traffic value from the TC sensor 51, a ventilation-planning setter 57 that calculates a working plan value representing the amount of work to be done by the ventilator 55 on the basis of the predicted traffic value, and a ventilation feedback controller 58.

To put it concretely, the TC sensor 51 counts the number of automobiles in a cycle of one hour. The traffic volume predictor 56 accumulates the number of automobiles output from the TC sensor 51 and makes out a one-day traffic pattern for small cars and a one-day traffic pattern for large-sized cars separately. The traffic patterns are classified into several classes, for example, a weekday, the day before holiday, a holiday, the day after holiday and the like, and then averaged in the respective classes, thereby making basic traffic patterns in the respective classes. In case of estimating the amount of traffic in this state, the predicted traffic value is determined by adjusting the basic traffic pattern that corresponds to the day to be estimated in light of a change of the traffic on that day.

The ventilation-planning setter 57 estimates the amount of pollutant and the ability to ventilate in the next cycle on the basis of the predicted traffic value that is obtained from the traffic volume predictor 56, and calculates the working plan value needed for controlling visibility and air pollution density to be within a satisfactory range in the next cycle. The working plan value becomes the basis for determining the amount of work to be done by the ventilator 55 in the next cycle.

The ventilation feedback controller 58 calculates a feedback control value, which is also needed for controlling visibility and air pollution density to be within a satisfactory range in the next cycle, on the basis of the VI value from the VI sensor 52, the carbon monoxide density from the CO sensor 53, the wind direction and the wind velocity from the AV sensor 54, and outputs the feedback control value to a plan/feedback cooperation controller 59.

The plan/feedback cooperation controller 59 cooperates between the working plan value from the ventilation-planning setter 57 and the feedback control value from the ventilation feedback controller 58, and determines an operation command for the ventilator 55. The ventilator 55 is controlled on the basis of the operation command.

There has been another control system for ventilating a tunnel that uses only a feedback control for middle-sized tunnels as shown in FIG. 2.

As described above, the control apparatus controls to keep the VI value and the carbon monoxide density within a satisfactory range by controlling the ventilator 55 in consideration of drivers' safety and comfortableness.

Since it is generally known that the carbon monoxide density can be kept much lower than a permissible value by controlling the VI value to be within a satisfactory range, the VI value is the most important control index for ventilating tunnels.

The VI sensor 52 includes a light-projector and a light-interceptor, and the light-projector and the light-interceptor are disposed at intervals of 100 meters, thereby measuring an attenuation rate of a laser beam radiated from the light-projector at the time that the laser beam reaches to the light-interceptor.

In the conventional control apparatus, the attenuation rate measured by the VI sensor 52 is used as an index that represents visibility for drivers. However, there are some following problems.

(1) The VI sensor 52 is disposed near a wall of the tunnel, which does not match the actual situation. Because, a portion that visibility should be kept well for drivers is not by the wall, but a portion that is about one meter apart from a road on which drivers are traveling.

(2) An attenuation rate of a laser beam is used as an index that represents visibility for drivers. However, the attenuation rate does not directly correspond to visibility for drivers.

(3) A range that the VI sensor may measure a VI value is limited to an area at which the VI sensor is disposed. Accordingly, in order to measure the VI values throughout a tunnel, a large number of VI sensors are required. As a result, it is very difficult to realize such system due to an increase in installation costs.

(4) With regard to the TC sensor 51, there are several types of TC sensors as described below. But they have their own problems.

a. Ultrasonic waves type

An ultrasonic generating and receiving apparatus emits an ultrasonic wave toward around a road surface intermittently and receives the reflected wave from automobiles or the road surface. The ultrasonic apparatus detects the existence of automobiles by comparing the reflected waves from automobile and the road surface.

b. Optical type

An infrared light generating and receiving apparatus emits an infrared light toward around a road surface and receives the reflected light from automobiles or the road surface. The infrared light apparatus detects the existence of automobiles by comparing the reflected lights from the automobile and the road surface.

c. Loop coil type

A loop coil is laid under a road that automobiles are traveling. The existence of automobiles is detected by means of current flowing into the loop coil at the time that automobiles pass over the loop coil.

In these TC sensors, the existence of automobiles is detected by means of changes of ultrasonic waves, infrared lights or current of the loop coil, and the TC sensors also distinguish between small cars and large-sized cars at the same time.

However, there is a possibility that these TC sensors may detect as a large-sized car or count the number of automobiles erroneously, in case that two small cars travel continuously.

With regard to a tunnel in the mountains, since fog flows into the tunnel, visibility sometimes worsens. In this case, it is difficult for the conventional TC sensors to distinguish between exhaust gas and fog. That is, the TC sensors may not distinguish which of exhaust gas or fog makes the visibility worse. In general, visibility is improved by letting the outside air into the tunnel. Accordingly, in case that a deterioration of visibility results from the fog, the visibility may worsen.

Since the above-mentioned control apparatus may not fully grasp the actual condition of the tunnel, a ventilation control may delay, resulting in deterioration of visibility and air pollution density. On the other hand, the ventilator may be used more than is necessary, thereby increasing a waste of electricity.

SUMMARY OF THE INVENTION

Accordingly, one object of this invention is to provide a control apparatus for ventilating a tunnel that may grasp the actual condition of the tunnel and improve drivers' safety and comfortableness.

Another object of this invention is to provide a control apparatus for ventilating a tunnel that may save in electricity for a ventilator.

The present invention provides a control apparatus for a ventilator that ventilates a tunnel in response to visibility of the inside of the tunnel, including at least one picture image input device configured to take a picture of the inside of the tunnel, a visibility index determination device configured to determine a visibility index value on the basis of a picture image data of the picture taken by the picture image input device in light of a table representing a relationship between the picture image data and the visibility index value, a feedback controller configured to calculate an operation command for operating the ventilator on the basis of a feedback control value calculated by comparing the visibility index value with a target value of the visibility index value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is a block diagram of a conventional control apparatus;

FIG. 2(*b*) is a block diagram of a conventional control apparatus that uses only a feedback control for middle-sized tunnels;

FIG. 3(*b*) is a block diagram of a control apparatus of the first embodiment of the present invention;

FIG. 4(*b*) is a block diagram of a control apparatus of the second embodiment of the present invention;

FIG. 5(*b*) is a block diagram of a control apparatus of the third embodiment of the present invention;

FIG. 6(*b*) is a block diagram of a control apparatus of the fourth embodiment of the present invention;

FIG. 7(*b*) is a block diagram of a control apparatus of the fifth embodiment of the present invention;

FIG. 8(*b*) is a block diagram of a control apparatus of the sixth embodiment of the present invention.

DETAILED DESCRIPTION OF THE PREFERRED EMBODIMENT

The present invention is hereinafter described in detail by way of illustrative embodiments.

(First Embodiment)

Figure 3A:
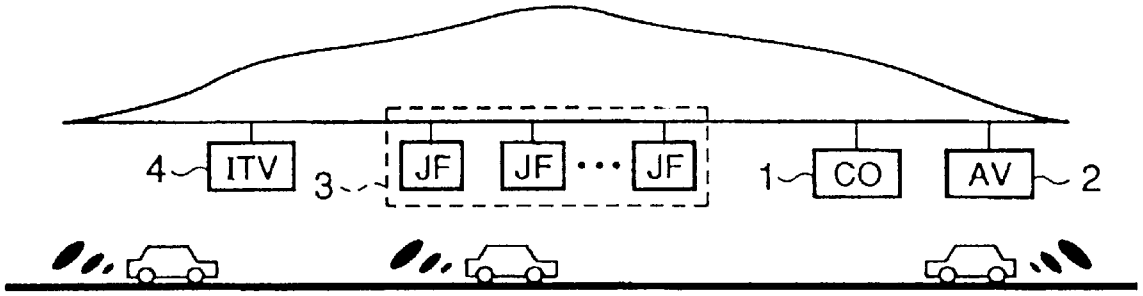
FIG. 3(*a*) is a schematic view showing ventilation equipment of the first embodiment.
Figure 3B:
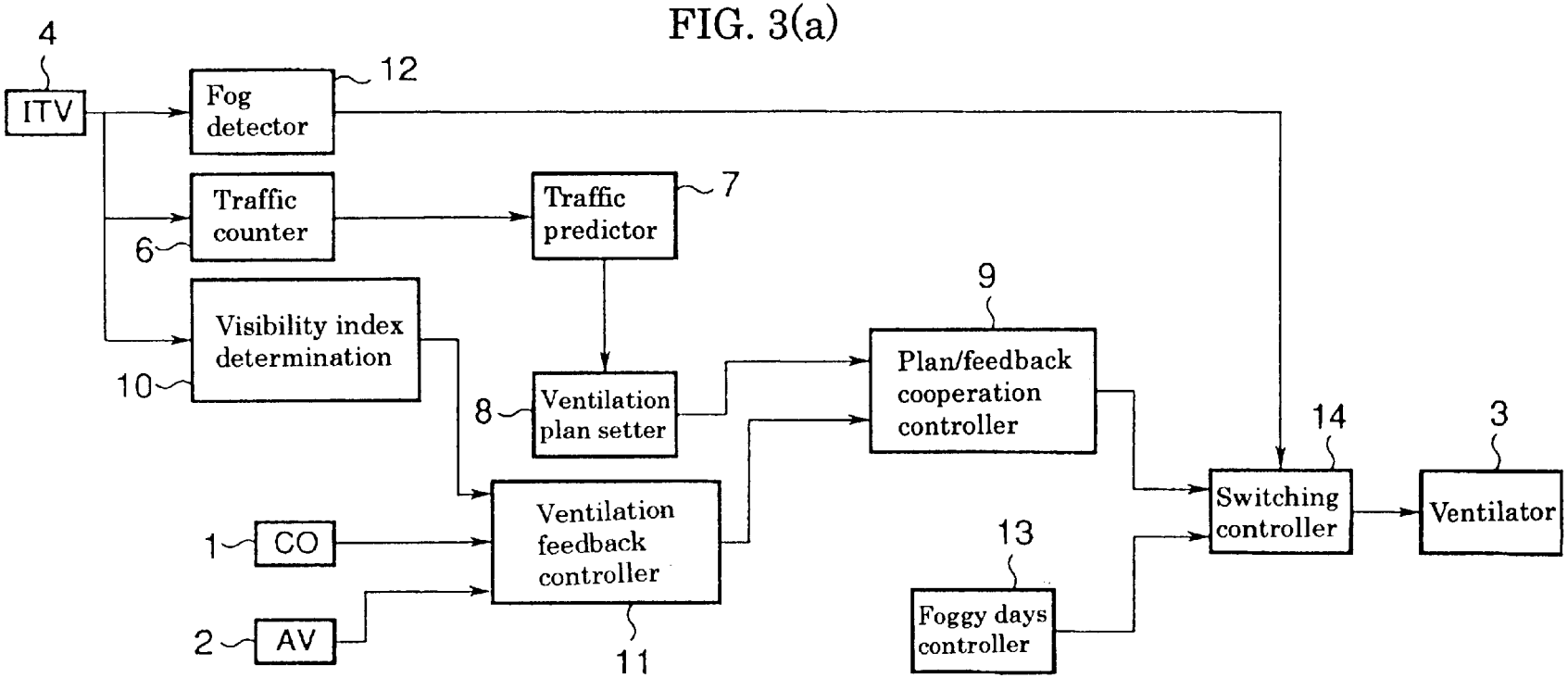

FIG. 3 shows a control apparatus for a ventilator of a first embodiment of the present invention. FIG. 3(*a*) is a schematic view showing ventilation equipment of the first embodiment. FIG. 3(*b*) is a block diagram of a control apparatus of the first embodiment of the present invention.

The ventilation equipment includes a CO(Carbon monoxide) sensor 1 that measures carbon monoxide density in a tunnel, an AV(Wind velocity) sensor that measures a wind direction and a wind velocity in the tunnel, a ventilator 3 that may have a blower, an exhauster, a jet fan, a dust chamber or the like, and a picture image input device 4 such as an ITV (Industrial Television) that takes a picture of the inside of the tunnel instead of VI sensors and TC sensors.

The ITV 4 is disposed at the higher position than the middle height portion of the tunnel and points downward so as to take a wide range of picture of the inside of the tunnel. The ITV 4 may be disposed to point in parallel with the wall of the tunnel. The ITV 4 may oscillate periodically or oscillate in response to traffic congestion in order to take a wider range of picture.

The control apparatus includes a traffic counter 6 that measures the amount of traffic in the tunnel on the basis of a picture image data of the picture taken by the ITV4, a traffic volume predictor 7 that predictes the amount of traffic corresponding to the number of automobiles in every fixed cycle on the basis of the measured traffic value measured by the traffic counter 6, a ventilation-planning setter 8 that calculates a working plan value representing the amount of work to be done by the ventilator 3, and a plan/feedback cooperation controller 9.

The traffic counter 6 distinguishes between small cars and large-sized cars on the ground of a pattern or a size of the specific picture appeared in the picture image data of the picture taken by the ITV 4, and counts the number of automobiles.

In the same way as the traffic volume predictor 56, the traffic volume predictor 7 accumulates the number of automobiles in a cycle of one hour and makes out a one-day traffic pattern for small cars and a one-day traffic pattern or large-sized cars separately. The respective traffic patterns for one month are classified into several classes, for example, a weekday, the day before holiday, a holiday, the day after holiday and other singular days, and then averaged in the respective classes, thereby making basic traffic patterns in the respective classes. In case of estimating the amount of traffic in this state, the predicted traffic value is obtained by adjusting the basic traffic pattern that corresponds to the day to be estimated in light of a change of the traffic on that day.

The ventilation-planning setter 8 estimates the amount of pollutant and the ability to ventilate in the next cycle on the basis of the predicted traffic value that is obtained from the traffic volume predictor 7, and calculates the working plan value needed for controlling visibility and air pollution density to be within a satisfactory range in the next cycle.

The plan/feedback cooperation controller 9 cooperates between the working plan value from the ventilation-planning setter 8 and a feedback control value from a ventilation feedback controller 11, and then determines an operation command for the ventilator 3. The plan/feedback cooperation controller 9 mainly uses the working plan value from the ventilation-planning setter 8 and uses the feedback control value for correcting the working plan value, thereby determining a more precise operation command for the ventilator. Conversely, the plan/feedback cooperation controller 9 may mainly use the feedback control value and use the working plan value for correcting the feedback control value.

Further, the control apparatus includes a visibility index determination device 10, the ventilation feedback controller 11, a fog detector 12, a foggy days controller 13 and a switching controller 14.

The visibility index determination device 10 determines a visibility index value representing the extent of visibility for drivers on the basis of the picture image data from the ITV 4 in light of a table that expresses a relationship between the picture image data and the visibility index value corresponding to a driver's actual feeling of visibility. The relationship is decided on the basis of experimentation in advance.

The ventilation feedback controller 11 calculates a feedback control value on the basis of the visibility index value from the visibility index determination device 10, the carbon monoxide density from the CO sensor 1, the wind direction, the wind velocity from the AV sensor 2, and the respective target values thereof, and outputs the feedback control value to the plan/feedback cooperation controller 9. The ventilation feedback controller 11 mainly uses the visibility index value and the carbon monoxide density, because the visibility index value indicates actual visibility for drivers precisely and the carbon monoxide density affects drivers' life and death. The wind direction and the wind velocity are used for correction. A conventional PI control, PID control or fuzzy control may be used as a feedback control in order to calculate the feedback control value.

The fog detector 12 detects the existence of fog in the tunnel on the basis of the picture image data from the ITV 4. For example, since the picture image data empirically has a large black area concerning exhaust gas, and has a large white area concerning fog, the existence of fog may be detected by judging the size of the white area.

The foggy days controller 13 functions to output an operation command for the ventilator 3 so as to stop letting the outside air into the tunnel or to discharge the inside air of the tunnel.

The switching controller 14 ordinarily outputs the operation command from the plan/feedback cooperation controller 9 to the ventilator 3, and outputs the operation command from the foggy days controller 13 to the ventilator 3 only if the fog detector 12 detects the existence of fog.

An operation of the above-mentioned control apparatus is hereinafter described.

The CO sensor 1, the AV sensor and the ITV 4 measure the carbon monoxide density, the wind direction and the wind velocity, and take a picture at all times in order to see the condition of the tunnel.

In this state, picture image data of the picture taken by the ITV 4 is outputted to the traffic counter 6, the visibility index determination device 10 and the fog detector 12.

The traffic counter 6 extracts images corresponding to automobiles from the picture image data and counts the number of images. The traffic counter 6 separately counts small cars and large-sized cars by comparing the images with a reference area or a reference pattern, and outputs the number of automobiles to the traffic volume predictor 7 as the measured traffic values.

The traffic volume predictor 7 accumulates the number of automobiles counted by the traffic counter 6 in a cycle of one hour and makes out a one-day traffic pattern for small cars and a one-day traffic pattern for large-sized cars separately. The respective traffic patterns for one month are classified into several classes, for example, a weekday, the day before holiday, a holiday, the day after holiday and other singular days, and then averaged in the respective classes, there by making basic traffic patterns in the respective classes. In case of estimating the amount of traffic in this state, the predicted traffic value is obtained by adjusting the basic traffic pattern that corresponds to the day to be estimated in light of a change of the traffic on that day.

The predicted traffic value is provided to the ventilation-planning setter 8. The ventilation-planning setter 8 estimates the amount of pollutant and the ability to ventilate in the next cycle on the basis of the predicted traffic value that is obtained from the traffic volume predictor 7, and calculates the working plan value needed for controlling visibility and air pollution density to be within a satisfactory range in the next cycle. Then, the working plan value is supplied to the plan/feedback cooperation controller 9.

The visibility index determination device 10 determines a visibility index value on the basis of the picture image data from the ITV 4 in light of a table representing a relationship between the picture image data and the visibility index value corresponding to a driver's actual feeling of visibility, and outputs the visibility index value to the ventilation feedback controller 11. The relationship is decided on the basis of experimentation in advance.

Further, the relationship is made by analyzing the extent of drivers' ability to recognize visual information needed for drivers from the point of view of the physiology, and repeating experiments. For example, it is tested how far drivers can see objects on a road ahead, or how far drivers can see stop lamps of a front car ahead. The visibility index value may be set to 0%, if drivers can not see the objects at all. Conversely, the visibility index value may be set to 100%, if drivers can see the objects clearly. The middle of the visibility index value may also be expressed with percentage.

The ventilation feedback controller 11 calculates a feedback control value on the basis of the visibility index value, the carbon monoxide density, the wind direction, the wind velocity, and the respective target values thereof, and outputs the feedback control value to the plan/feedback cooperation controller 9. The ventilation feedback controller 11 mainly uses the visibility index value and the carbon monoxide density, because the visibility index value indicates actual visibility for drivers precisely and the carbon monoxide density affects drivers' life and death. The wind direction and the wind velocity are used for correction.

The plan/feedback cooperation controller 9 cooperates between the working plan value from the ventilation-planning setter 8 and the feedback control value from the ventilation feedback controller 11, and then determines an operation command for the ventilator 3. The plan/feedback cooperation controller 9 mainly uses the working plan value from the ventilation-planning setter 8 and uses the feedback control value for correcting the working plan value, thereby determining a more precise operation command for the ventilator 3. Conversely, the plan/feedback cooperation controller 9 may mainly use the feedback control value and use the working plan value for correcting the feedback control value.

The fog detector 12 detects the existence of fog in the tunnel on the basis of the picture image data from the ITV 4. The existence of fog may be detected by judging the size of the white area caused by fog in the picture image data.

The switching controller 14 inputs the operation command from the plan/feedback cooperation controller 9 and ordinarily outputs the operation value to the ventilator 3, but outputs the operation command from the foggy days controller 13 to the ventilator 3 so as to stop letting the outside air into the tunnel or to discharge the inside air of the tunnel only if the fog detector 12 detects the existence of fog.

According to the first embodiment, the following advantages may be obtained compared to the conventional control apparatus.

(1) Since picture image data is used as an index for visibility for drivers, the entire condition of the inside of the tunnel may be grasped, and the ventilator may be controlled on the basis of the visibility index corresponding to the actual drivers' feeling, thereby improving drivers' safety and comfortableness and saving in electricity for the ventilator.

(2) With regard to a tunnel in the mountains, visibility sometimes worsens, because fog flows into the tunnel. However, since the fog detector 12 may detect the existence of fog by distinguishing between exhaust gas and fog, visibility may be improved appropriately by controlling the ventilator 3 so as to stop letting the outside air into the tunnel or to discharge the inside air of the tunnel, thereby improving drivers' safety and comfortableness.

(3) Since the amount of traffic is measured on the basis of picture image data, the precision of the distinction between small cars and large-sized cars may be improved compared to the TC sensor, thereby improving the precision of the measured traffic value and efficiency of the ventilation control.

(4) Since the control apparatus may dispense with the VI sensor and the TC sensor, a cost of management may reduce.

(Second Embodiment)

Figure 4A:
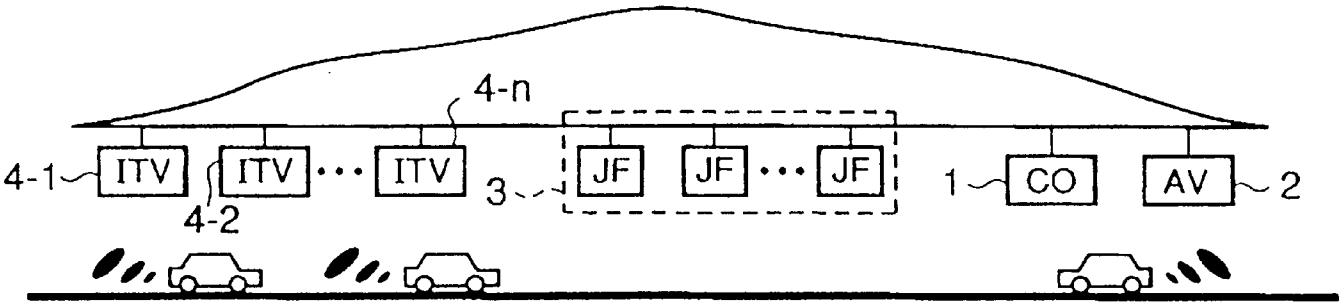
FIG. 4(*a*) is a schematic view showing ventilation equipment of the second embodiment.
Figure 4B:
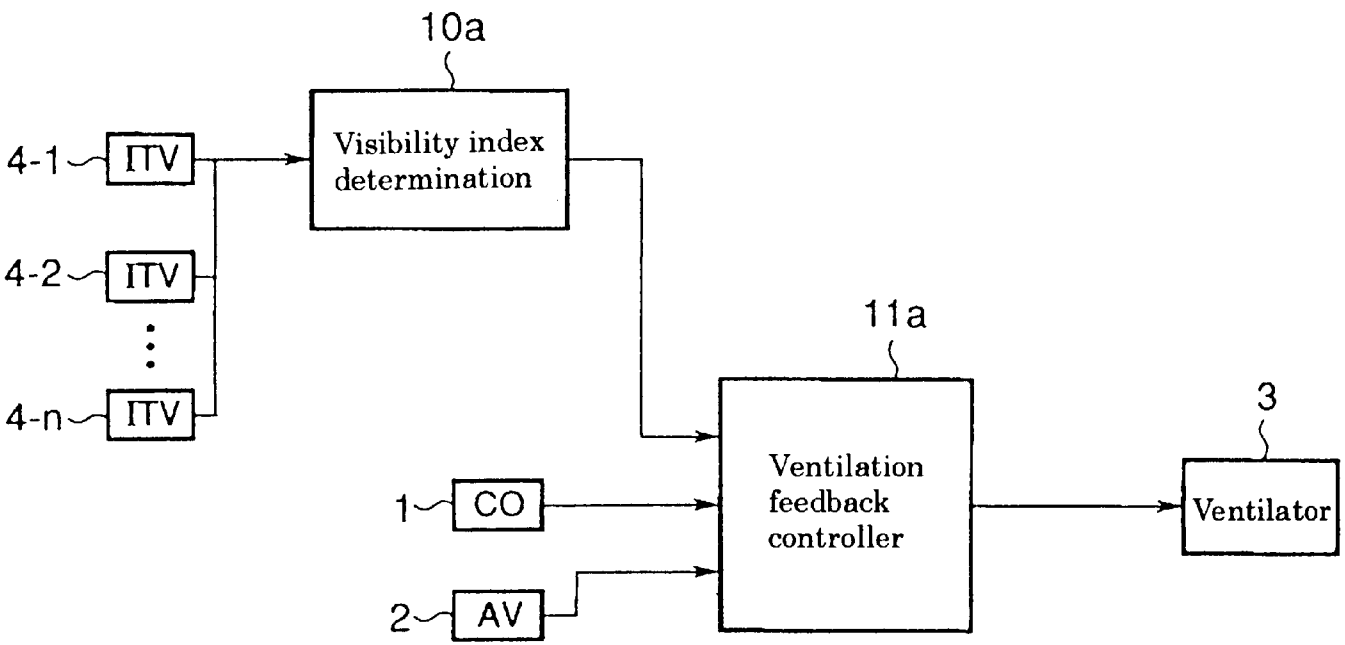

FIG. 4 shows a control apparatus for a ventilator of a second embodiment of the present invention. FIG. 4(*a*) is a schematic view showing ventilation equipment of the second embodiment. FIG. 4(*b*) is a block diagram of a control apparatus of the second embodiment of the present invention. In FIG. 4, the detail description of the same components as FIG. 3 is omitted and the same numerals are given to the components.

In the second embodiment, a plurality of ITVs is disposed in the tunnel at intervals in order to take pictures throughout the tunnel. If some ITVs are already disposed in the tunnel for use of traffic observation, the control system may share the ITVs effectively. In the following description, although the control system of the second embodiment adopts only a ventilation feedback controller for middle-sized tunnels shown in FIG. 2, the control system may adopt the control apparatus shown in FIG. 3.

The control system includes a plurality of ITVs 4-1, 4-2, . . . , 4-n disposed in the tunnel at intervals for taking pictures throughout the tunnel, a visibility index determination device 10*a* determines the respective visibility index values on the basis of picture image data of the pictures taken by the ITVs 4-1~n in light of a table representing a relationship between the picture image data and a visibility index value corresponding to a driver's actual feeling of visibility, and a ventilation feedback controller 11*a* that calculates an operation command for the ventilator 3 on the basis of a feedback control value calculated by means of the worst visibility index value in the visibility index values from the visibility index determination device 10*a,* the carbon monoxide density from the CO sensor 1, the wind direction and the wind velocity from the AV sensor 2, and the respective target values thereof in the same way as the ventilation feedback controller 11 in FIG. 3.

An operation of the control apparatus is hereinafter described.

The ITVs 4-1, 4-2~4-n, which are disposed in the tunnel at intervals for taking pictures throughout the tunnel, take pictures of traffic conditions in the respective corresponding areas, and output the picture image data to the visibility index determination device 10*a*.

The visibility index determination device 10*a* stores the respective picture image data taken by the ITVs 4-1~n into a picture memory in prescribed order, and determines the respective visibility index values on the basis of the picture image data. The visibility index determination device 10*a* outputs the worst visibility index value in the visibility index values to the ventilation feedback controller 11*a*. Since a way to determine the visibility index value is the same as the control apparatus of the first embodiment, an explanation of the way is omitted.

The ventilation feedback controller 11*a* further inputs the carbon monoxide density from the CO sensor 1 and the wind direction and the wind velocity from the AV sensor 2 in addition to the worst visibility index value.

The ventilation feedback controller 11*a* calculates the feedback control value by comparing the worst visibility index value, the carbon monoxide density, the wind direction and the wind velocity with the respective target values thereof, and determines the operation command so that the visibility index value, the carbon monoxide density, the wind direction and the wind velocity meet the respective target values thereof. In this calculation, the ventilation feedback controller 11*a* mainly uses the visibility index value and the carbon monoxide density and uses the wind direction and the wind velocity for correction, thereby calculating the operation command appropriately and controlling the ventilator 3 efficiently.

According to the second embodiment, visibility index value is determined by picture image data taken by pluralities of ITVs disposed throughout the tunnel, thereby grasping the traffic condition throughout the tunnel precisely and controlling the ventilator appropriately. As a result, drivers' safety and comfortableness may improve. Further, an appropriate control may apply to the ventilator by detecting a deterioration of visibility quickly, thereby saving in electricity for the ventilator.

(Third Embodiment)

Figure 5A:
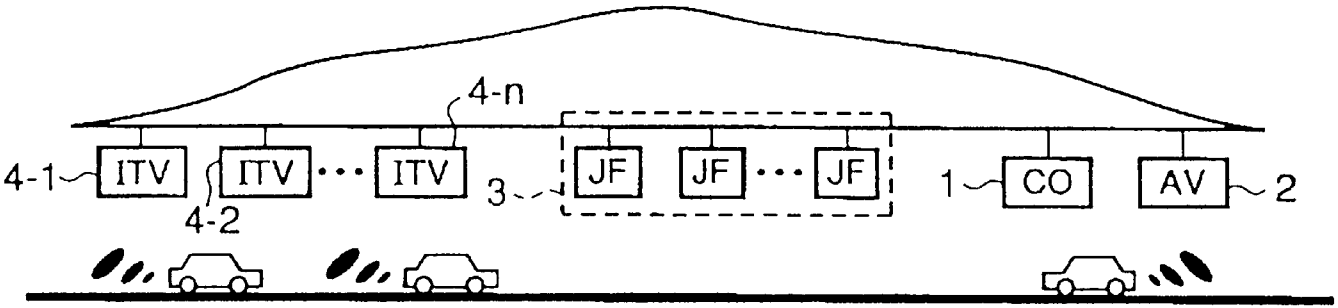
FIG. 5(*a*) is a schematic view showing ventilation equipment of the third embodiment.
Figure 5B:
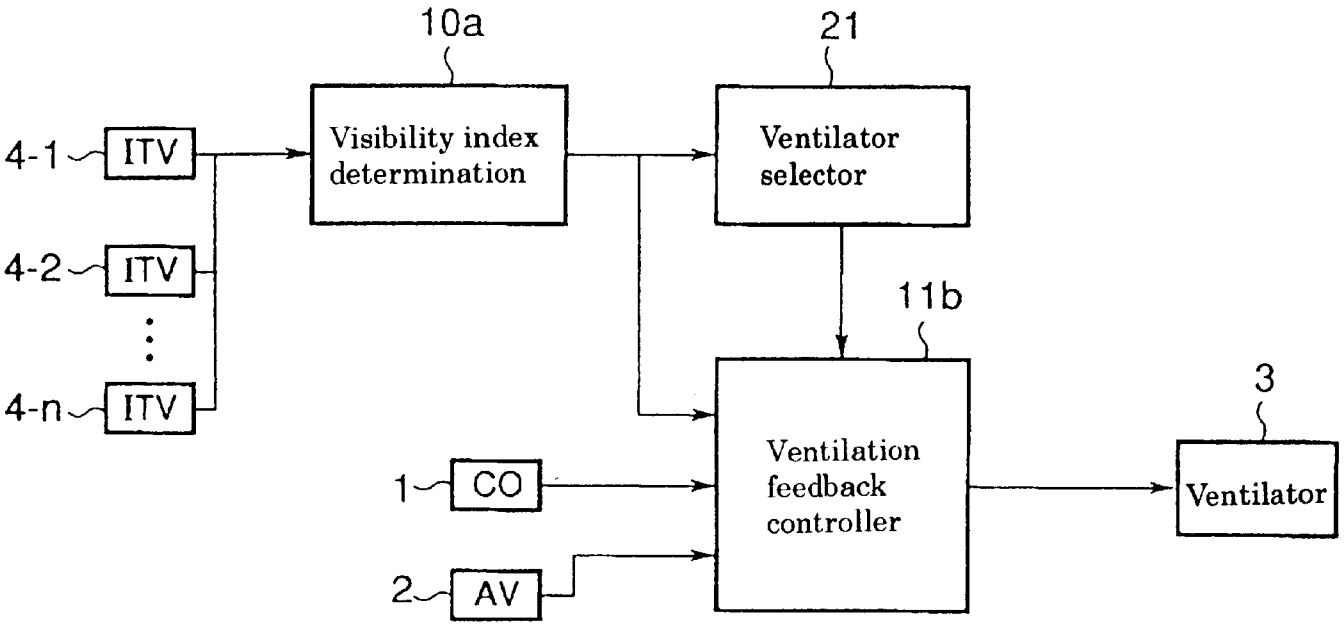

FIG. 5 shows a control apparatus for a ventilator of a third embodiment of the present invention. FIG. 5(*a*) is a schematic view showing ventilation equipment of the third embodiment. FIG. 5(*b*) is a block diagram of a control apparatus of the third embodiment of the present invention. In FIG. 5, the detail description of the same components as FIGS. 3 and 4 is omitted and the same numerals are given to the components.

In the third embodiment, the control apparatus selects the most effective ventilator that may clear the air in the corresponding area of the worst visibility index value effectively and controls the most effective ventilator.

The control system of the third embodiment includes a plurality of ventilators 3 disposed in a tunnel and a ventilator selector 21 in addition to the control system of the second embodiment shown in FIG. 4.

An operation of the control apparatus is hereinafter described.

The ITVs 4-1, 4-2~4-n, which are disposed in the tunnel at intervals for taking pictures throughout the tunnel, take pictures of traffic conditions in the respective corresponding areas, and output the picture image data to the visibility index determination device 10*a*. The visibility index determination device 10*a* stores the respective picture image data taken by the ITVs 4-1~n into a picture memory in prescribed order, and determines the respective visibility index values on the basis of the picture image data of the pictures taken by the ITVs 4-1~n in light of a table representing a relationship between the picture image data and a visibility index value corresponding to a driver's actual feeling of visibility. The visibility index determination device 10*a* outputs the worst visibility index value in the visibility index values and a position data corresponding to one of the ITVs 4-1~n having the worst visibility index value to the ventilator selector 21.

The ventilator selector 21 selects the most effective ventilator that may clear the air in the corresponding area of the worst visibility index value effectively in light of a table representing a relationship between the position data and the most effective ventilator.

The ventilation feedback controller 11*b* calculates the feedback control value by comparing the worst visibility index value, the carbon monoxide density, the wind direction and the wind velocity with the respective target values thereof, and determines the operation command so that the worst visibility index value, the carbon monoxide density, the wind direction and the wind velocity meet the respective target values thereof. Further, the ventilation feedback controller 11*b* determines the operation command so as to give priority to the selected ventilator 3, that is the most effective ventilator, and to operate the selected ventilator 3. For example, the ventilation feedback controller 11*b* gives priority to an exhauster or a dust chamber disposed downstream form the ITV 4 having the worst visibility index value.

According to the third embodiment, in addition to the effects obtained by the second embodiment, the control apparatus may select the most effective ventilator capable of clearing the air in the corresponding area of the worst visibility index value effectively, thereby improving visibility quickly and operating the ventilators efficiently.

(Fourth Embodiment)

Figure 6A:
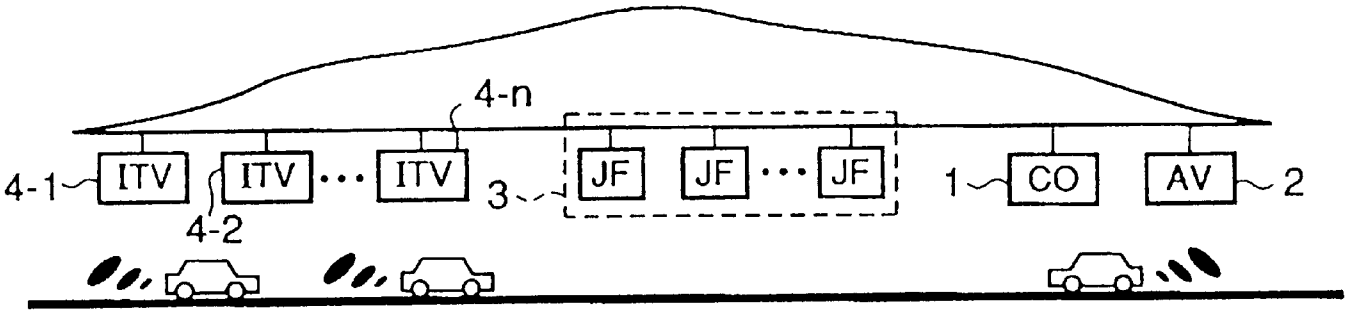
FIG. 6(*a*) is a schematic view showing ventilation equipment of the fourth embodiment.
Figure 6B:
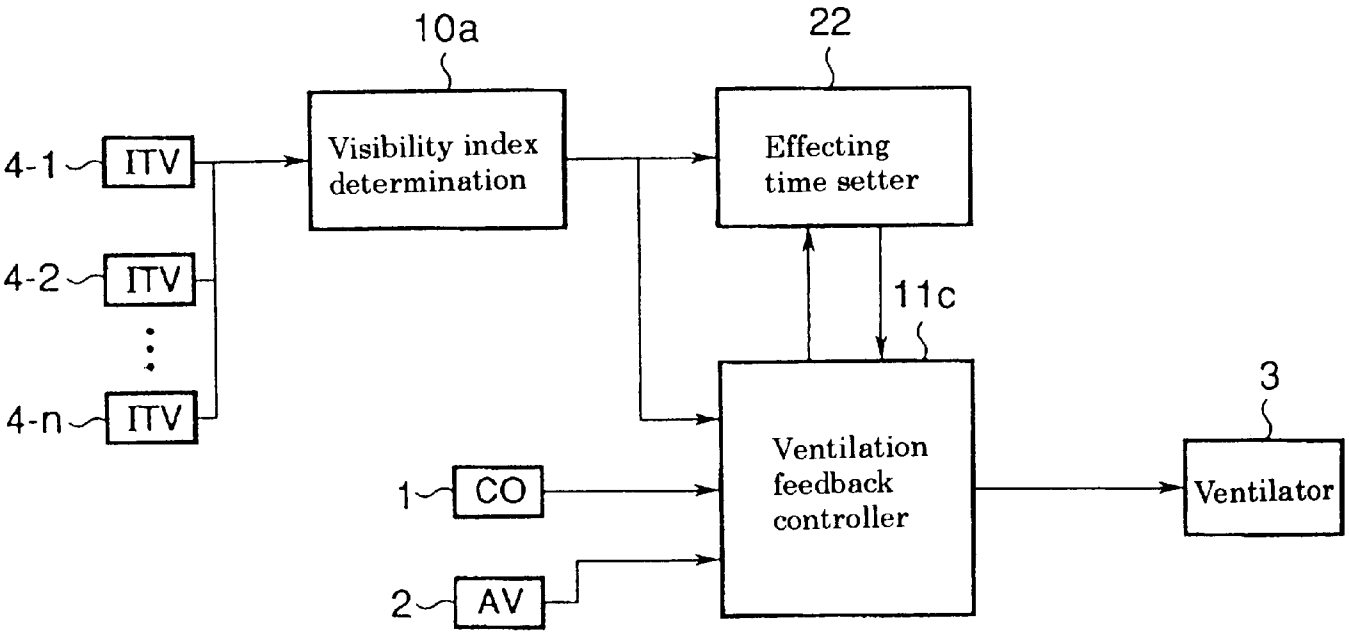

FIG. 6 shows a control apparatus for a ventilator of a fourth embodiment of the present invention. FIG. 6(*a*) is a schematic view showing ventilation equipment of the fourth embodiment. FIG. 6(*b*) is a block diagram of a control apparatus of the fourth embodiment of the present invention. In FIG. 6, the detail description of the same components as FIGS. 3 and 4 is omitted and the same numerals are given to the components.

In the fourth embodiment, the control apparatus sets an effecting time to continuously operate a ventilator without changing an operation command until a satisfactory result is obtained after operating the ventilator with the operation command.

The control system of the fourth embodiment includes an effecting time setter 22 in addition to the control system of the second embodiment shown in FIG. 4.

The effecting time setter 22 sets the effecting time for the ventilator 3 in order to continuously operate the ventilator 3 without changing the operation command, watching the change of visibility index value after operating the ventilator with the operation command.

An operation of the control apparatus is hereinafter described.

The visibility index determination device 10*a* stores the respective picture image data taken by the ITVs 4-1~n into a picture memory in prescribed order, and determines the respective visibility index values on the basis of the picture image data of the pictures taken by the ITVs 4-1~n in light of a table representing a relationship between the picture image data and a visibility index value corresponding to a driver's actual feeling of visibility. The visibility index determination device 10*a* outputs the worst visibility index value in the visibility index values to both a ventilation feedback controller 11*c* and the effecting time setter 22.

The ventilation feedback controller 11*c* calculates the operation command on the basis of the worst visibility index value and outputs the operation command to the ventilator 3 and the effecting time setter 22.

It is known that it takes several minutes or tens of minutes to have a satisfactory result of visibility after operating the ventilator. Therefore, the effecting time setter 22 sets the effecting time in order to continuously operate the ventilator 3 for a fixed time.

Since the effecting time is a fixed value, the ventilator 3 may be operated more than is necessary.

Accordingly, the effecting time setter 22 watches the change of the worst visibility index value and outputs a cancellation command for canceling the effecting time to the ventilation feedback controller 11*c* when a satisfactory result of visibility is 1 the basis of the worst visibility index value.

The ventilation feedback controller 11*c* keeps outputting the operation command for the effecting time, but cancels the operation command when the cancellation command is outputted from the effecting time setter 22.

According to the fourth embodiment, in addition to the effects obtained by the second embodiment, the control apparatus may set the effecting time for the ventilator appropriately and may operate the ventilator effectively until a satisfactory result of visibility is obtained, thereby improving visibility adequately and saving in electricity for the ventilator.

(Fifth Embodiment)

Figure 7A:
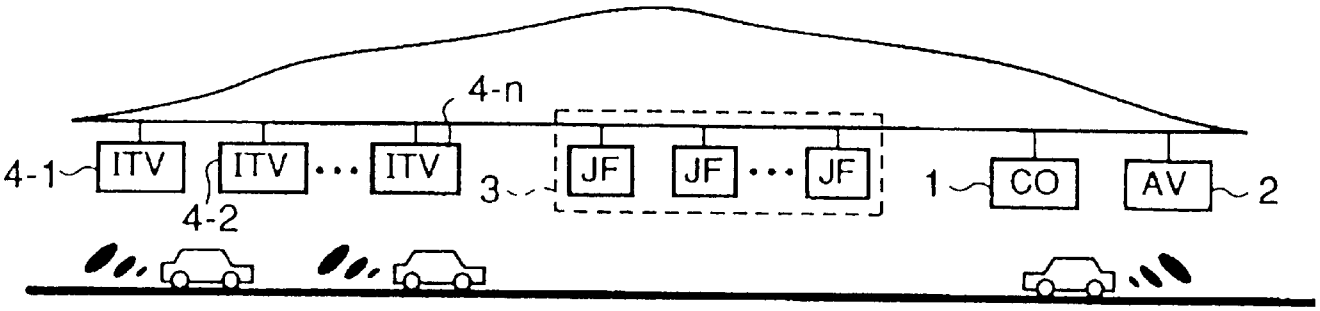
FIG. 7(*a*) is a schematic view showing ventilation equipment of the fifth embodiment.
Figure 7B:
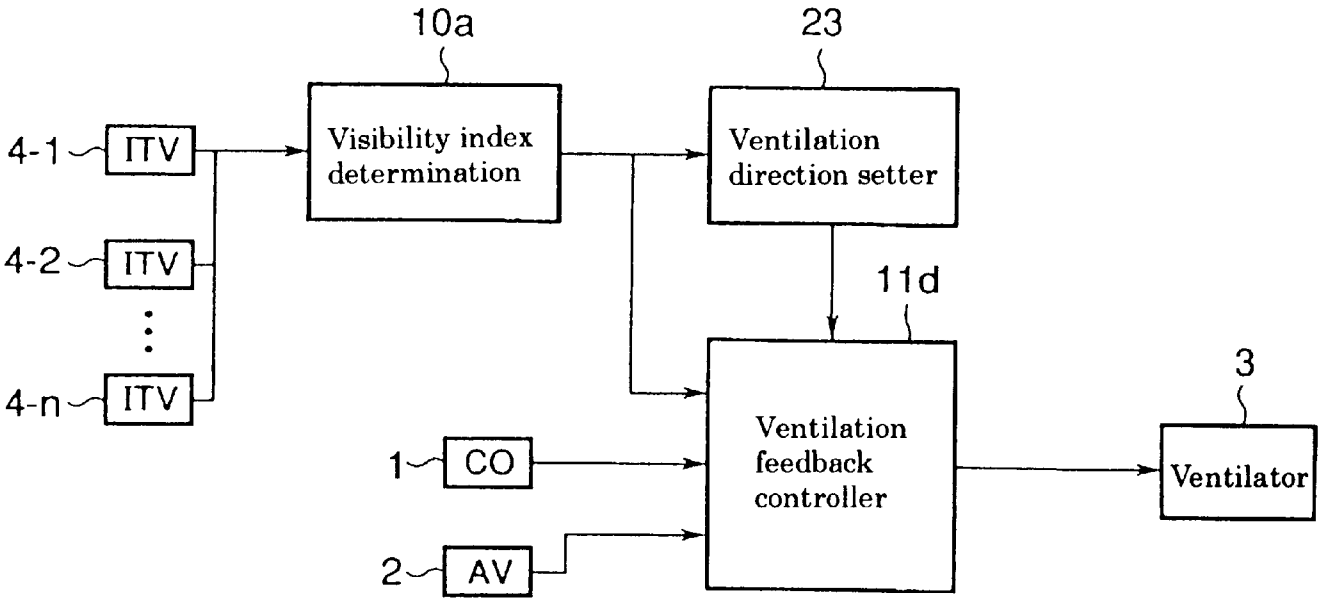

FIG. 7 shows a control apparatus for a ventilator of a fifth embodiment of the present invention. FIG. 7(*a*) is a schematic view showing ventilation equipment of the fifth embodiment. FIG. 7(*b*) is a block diagram of a control apparatus of the fifth embodiment of the present invention. In FIG. 7, the detail description of the same components as FIGS. 3 and 4 is omitted and the same numerals are given to the components.

In this embodiment, the control apparatus changes a ventilation direction of the ventilator on the basis of the visibility index value.

The control system of the fifth embodiment includes a ventilation direction setter 23 in addition to the control system of the second embodiment shown in FIG. 4.

The ventilation direction setter 23 determines which direction the ventilator should blow the air on the basis of the visibility index value from the visibility index determination device 10*a,* and functions to output a ventilation direction command to a ventilation feedback controller 11*d* on the basis of the determination.

An operation of the above-mentioned control apparatus is hereinafter described.

The visibility index determination device 10*a* stores the respective picture image data taken by the ITVs 4-1~n into a picture memory in prescribed order, and determines the respective visibility index values on the basis of the picture image data of the pictures taken by the ITVs 4-1~n in light of a table representing a relationship between the picture image data and a visibility index value corresponding to a driver's actual feeling of visibility. The visibility index determination device 10*a* outputs the worst visibility index value in the visibility index values to both a ventilation feedback controller 11*d* and the ventilation direction setter 23.

The ventilation direction setter 23 watches a distribution of the visibility index values corresponding to the respective ITVs 4-1~n, and determines which direction the ventilator 3 should blow the air. Further, the ventilation direction setter 23 outputs the ventilation direction command to the ventilation feedback controller 11*d.* For example, the control apparatus operates the ventilator 3 so as to blow the air toward the opening nearer to the area corresponding to the worst visibility index value, if the ventilator stays a stoppage state.

The ventilation feedback controller 11*d* determines the operation command for operating the ventilator 3 so as to blow the air in the direction determined by the ventilation direction setter 23.

According to the fifth embodiment, in addition to the effects obtained by the second embodiment, the control apparatus changes a ventilation direction of the ventilator so as to improve visibility quicker on the basis of a distribution of the visibility index values, thereby shortening a time to improve visibility and saving in electricity for the ventilator.

(Sixth Embodiment)

Figure 8A:
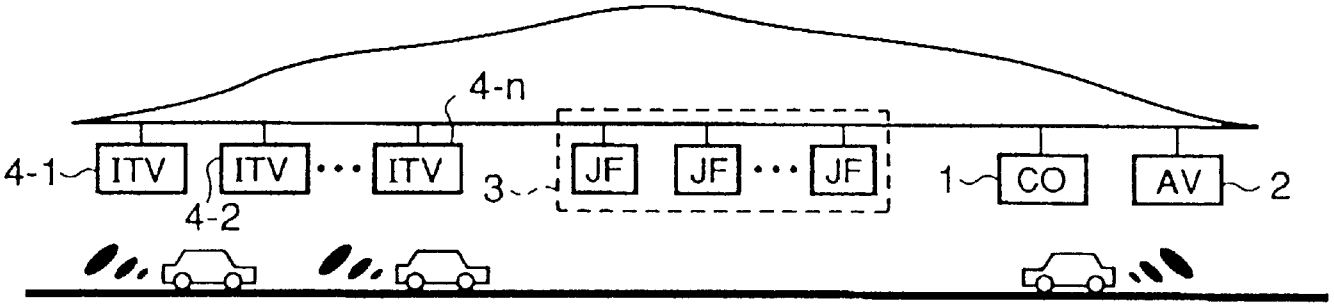
FIG. 8(*a*) is a schematic view showing ventilation equipment of the sixth embodiment.
Figure 8B:
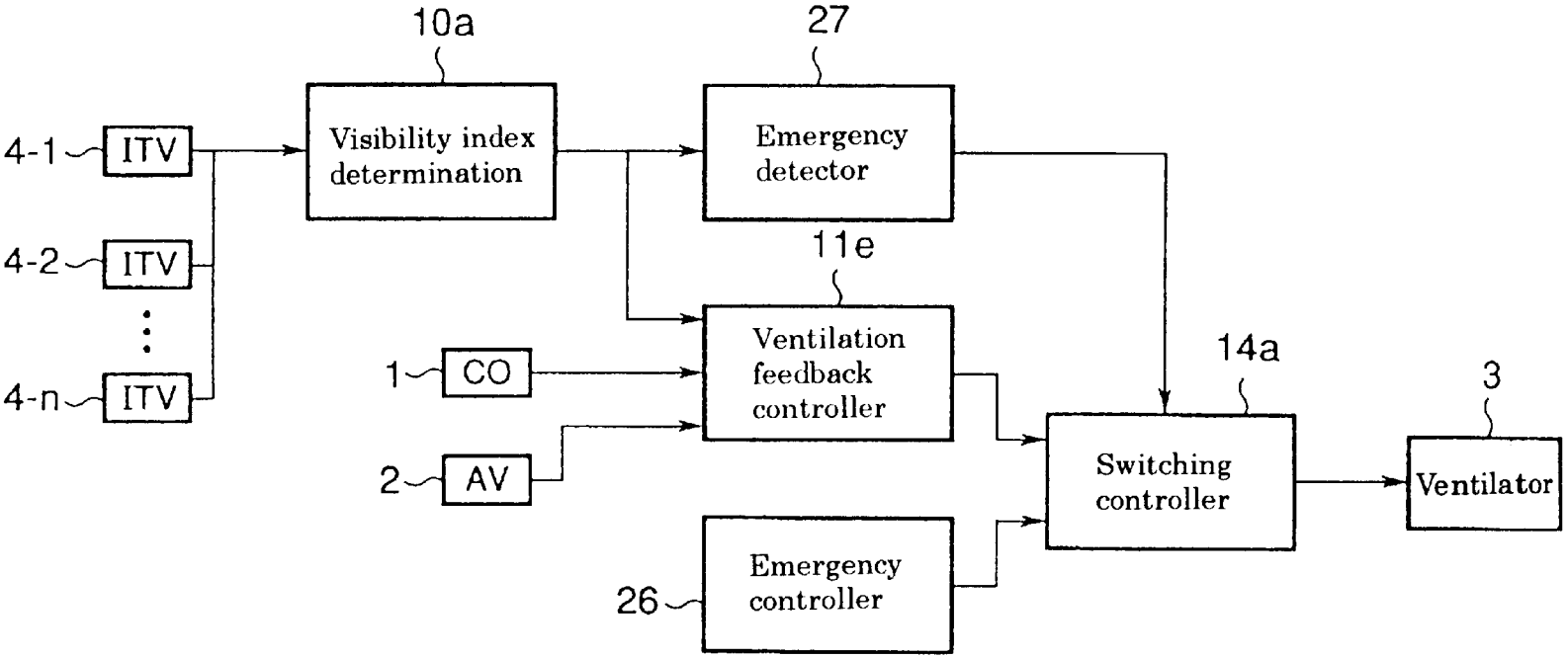

FIG. 8 shows a control apparatus for a ventilator of a sixth embodiment of the present invention. FIG. 8(*a*) is a schematic view showing ventilation equipment of the sixth embodiment. FIG. 8(*b*) is a block diagram of a control apparatus of the sixth embodiment of the present invention. In FIG. 8, the detail description of the same components as FIGS. 3 and 4 is omitted and the same numerals are given to the components.

In this embodiment, the control apparatus operates the ventilator so as to increase the ability to ventilate the tunnel quickly when a visibility of the tunnel extraordinarily deteriorates.

The control system of the sixth embodiment includes an emergency controller 26, an emergency detector 27 and a switching controller 14*a* that ordinarily outputs a first operation command from a ventilation feedback controller 11*e* to the ventilator 3, and outputs a second operation command from the emergency controller 26 to the ventilator 3 only if the emergency detector 12 detects an extraordinary deterioration in visibility of the tunnel.

The emergency controller 26 calculates the second operation command by adding a predetermined value to the present operation command in order to increase the ability to ventilate the tunnel.

The emergency detector 27 detects an extraordinary deterioration in visibility of the tunnel by comparing the visibility index value with a predetermined value.

An operation of the above-mentioned control apparatus is hereinafter described.

The visibility index determination device 10*a* stores the respective picture image data taken by the ITVs 4-1~n into a picture memory in prescribed order, and determines the respective visibility index values on the basis of the picture image data of the pictures taken by the ITVs 4-1~n in light of a table representing a relationship between the picture image data and a visibility index value corresponding to a driver's actual feeling of visibility. The visibility index determination device 10*a* outputs the worst visibility index value in the visibility index values to both a ventilation feedback controller 11*e* and the emergency detector 27.

The switching controller 14*a* inputs the first operation command from the ventilation feedback controller 11*e* and ordinarily outputs the first operation command to the ventilator 3, but outputs the second operation command from the emergency controller 26 to the ventilator 3 so as to increase the ability to ventilate the tunnel when the emergency detector 12 detects an extraordinary deterioration in visibility of the tunnel.

According to the sixth embodiment, in addition to the effects obtained by the second embodiment, since the control apparatus operates the ventilator so as to increase the ability to ventilate the tunnel quickly when a visibility of the tunnel extraordinarily deteriorates for some reason, the visibility of the tunnel may quickly improve. Further, an operation test for the ventilator may safely be acted.

Figure 1A:
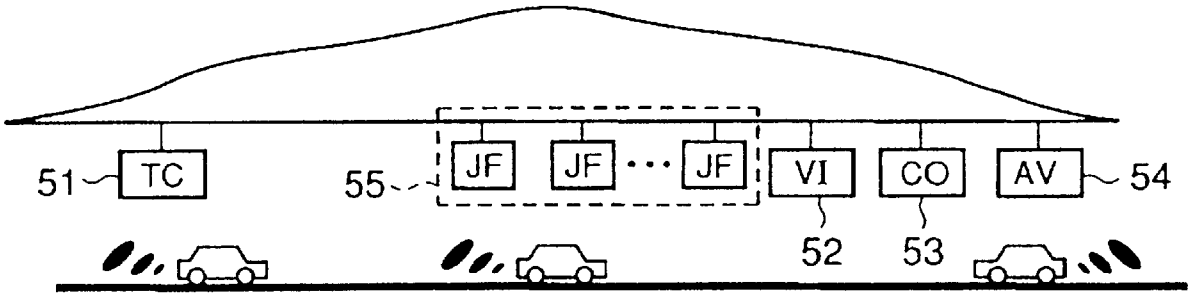
FIG. 1(a) (PRIOR ART)
FIG. 1(*a*) is a schematic view showing one example of the installation of ventilation equipment in the tunnel.
Figure 1B:
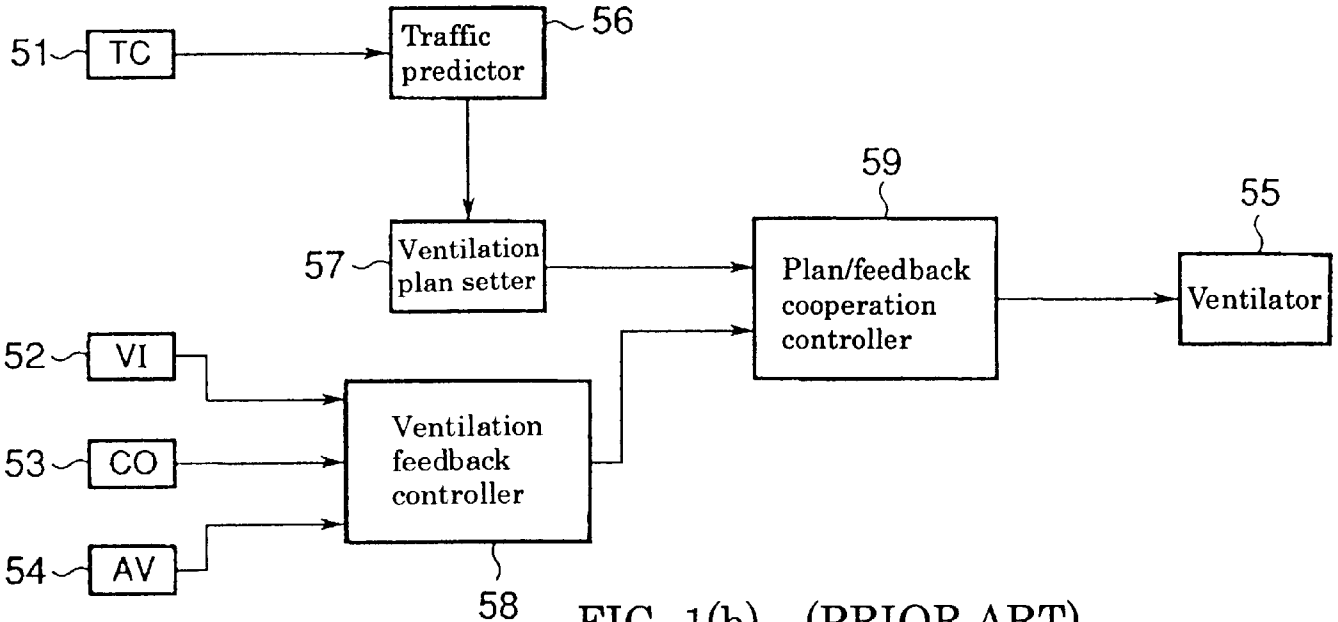
FIG. 1(b) (PRIOR ART)
Figure 2A:
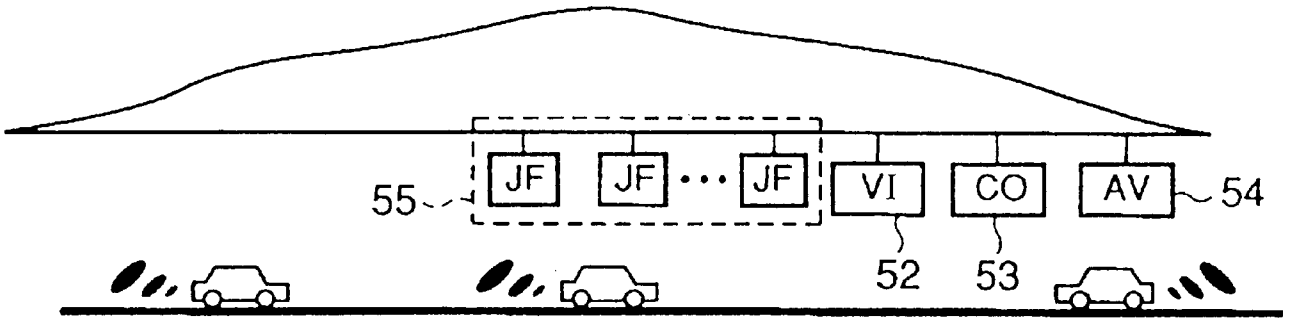
FIG. 2(a) (PRIOR ART)
FIG. 2(*a*) is a schematic view showing one example of the installation of ventilation equipment in the tunnel.
Figure 2B:
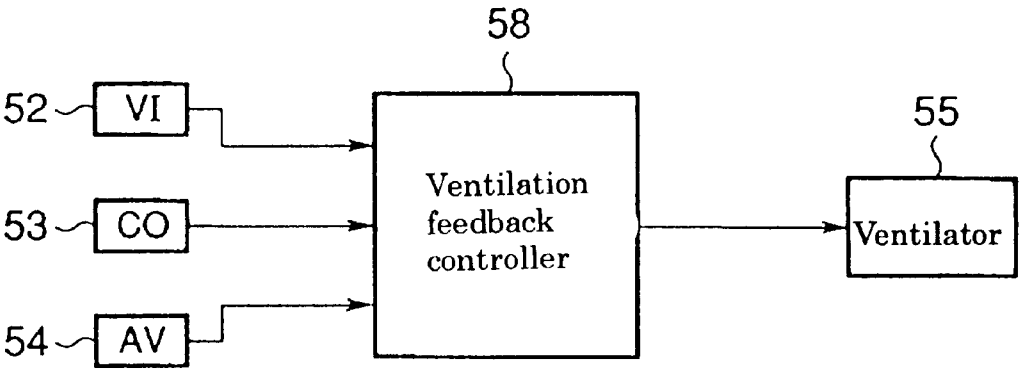
FIG. 2(b) (PRIOR ART)

In the third through sixth embodiments, although the control apparatuses adopt only a ventilation feedback controller as shown in FIG. 2, the control apparatuses may adopt the traffic counter 6, the traffic volume predictor 7, the ventilation-planning setter 8 and the plan/feedback cooperation controller 9 shown in FIG. 3.

According to the present invention, since the control apparatus grasps visibility of the inside of the tunnel by means of picture image data from the ITV that takes a picture of condition of the tunnel, visibility of the tunnel for drivers may be grasped precisely compared to the conventional VI sensor. Further, efficiency of the ventilation control may improve. Furthermore, deterioration of visibility of the tunnel caused by exhaust gas and fog may be improved quickly. Moreover, the control apparatus may contribute to save in electricity for the ventilator.

Various modifications and variations are possible in light of the above teachings. Therefore, it is to be understood that within the scope of the appended claims, the present invention may be practiced otherwise than as specifically described herein.

What is claimed is:

1. A control apparatus for a ventilator that ventilates a tunnel in response to visibility of the inside of said tunnel, comprising:

at least one picture image input device configured to take a picture of the inside of said tunnel;

a visibility index determination device configured to determine a visibility index value on the basis of a processed picture image data of said picture taken by said picture image input device using a table representing a relationship between said picture image data and a visibility index value corresponding to an actual feeling of visibility for a driver, said relationship being determined by experimentation in advance; and a feedback controller configured to calculate an operation command for operating said ventilator on the basis of a feedback control value calculated by comparing said visibility index value with a target value of said visibility index value.

2. The control apparatus as recited in claim 1, further comprising:

a fog detector configured to detect an existence of fog in said tunnel on the basis of said picture image data, said feedback controller outputs said operation command for operating said ventilator so as not to let the outside air into said tunnel.

3. The control apparatus as recited in claim 1, further comprising:

a fog detector configured to detect an existence of fog in said tunnel on the basis of said picture image data, said feedback controller outputs said operation command for operating said ventilator so as to discharge the inside air of said tunnel.

4. The control apparatus as recited in claim 1, further comprising:

a traffic counter configured to measure an amount of traffic in said tunnel on the basis of said picture image data of said picture taken by said picture image input device;

a traffic volume predictor configured to predict the amount of traffic on the basis of the measured traffic value measured by said traffic counter; and a ventilation plan calculator configured to calculate a working plan value representing an amount of work to be done by said ventilator on the basis of the predicted traffic value predicted by said traffic volume predictor so that said visibility meets a target thereof, said feedback controller calculates said operation command on the basis of said feedback control value and said working plan value.

5. The control apparatus as recited in claim 1, further comprising:

a setter configured to set an effecting time to continuously operate said ventilator without changing said operation command and to output a cancellation command for canceling said effecting time to said feedback controller at the time that a satisfactory result of visibility is ascertained on the basis of said visibility index value;

said feedback controller keeps said operation command constant for said effecting time, but cancels said operation command when said cancellation command is outputted from said setter.

6. The control apparatus as recited in claim 1, further comprising:

said feedback controller calculates said operation command by adding a predetermined value to the present operation command in order to increase the ability to ventilate said tunnel if said visibility index value exceeds a predetermined value.

7. A control apparatus for a ventilator that ventilates a tunnel in response to visibility of the inside of said tunnel, comprising:

a plurality of picture image input devices configured to take pictures of the inside of said tunnel, and disposed at intervals;

a visibility index determination device configured to determine a plurality of visibility index values on the basis of processed picture image data of said pictures taken by said respective picture image input devices using a table representing a relationship between said picture image data and a visibility index value corresponding to an actual feeling of visibility for a driver, said relationship being determined by experimentation in advance; and a feedback controller configured to calculate an operation command for operating said ventilator on the basis of a feedback control value calculated by comparing a worst visibility index value in said visibility index values with a target value of said worst visibility index value.

8. The control apparatus as recited in claim 7, further comprising:

a ventilation direction selector configured to determine a ventilation direction that improves said visibility in a shortest time on the basis of said worst visibility index value, said feedback controller calculates said operation command for operating said ventilator so as to blow the inside air of said tunnel in said ventilation direction.

* * * * *